US006911012B2

(12) United States Patent
Kahn

(10) Patent No.: US 6,911,012 B2
(45) Date of Patent: Jun. 28, 2005

(54) APPARATUS AND METHOD FOR APPLYING A FRICTION MASSAGE STROKE

(76) Inventor: Rocky Kahn, 174 Santa Clara Ave., Oakland, CA (US) 94610

( * ) Notice: Subject to any disclaimer, the term of this patent is extended or adjusted under 35 U.S.C. 154(b) by 126 days.

(21) Appl. No.: 10/142,352

(22) Filed: May 9, 2002

(65) Prior Publication Data

US 2003/0212354 A1 Nov. 13, 2003

(51) Int. Cl.[7] ..... A61H 15/00

(52) U.S. Cl. ..... 601/99; 601/100; 601/102; 601/116

(58) Field of Search ..... 601/98, 99, 100, 601/101, 102, 103, 108, 112, 115, 116, 136, 86, 87, 90, 93, 94

(56) References Cited

U.S. PATENT DOCUMENTS 3,640,272 A * 2/1972 Hussey ..... 601/99
4,412,534 A * 11/1983 Hamabe et al. ..... 601/99
4,422,449 A * 12/1983 Hamabe ..... 601/99
4,491,127 A * 1/1985 Yamamura et al. ..... 601/116
4,574,786 A * 3/1986 Hashimoto et al. ..... 601/99
4,576,149 A * 3/1986 Otuka et al. ..... 601/99
4,886,051 A * 12/1989 White ..... 601/102
5,630,790 A * 5/1997 Ito ..... 601/102
6,066,106 A * 5/2000 Sherman et al. ..... 601/134

* cited by examiner

*Primary Examiner*—Gregory L. Huson
*Assistant Examiner*—Quang D. Thanh
(74) *Attorney, Agent, or Firm*—Porter, Wright, Morris & Arthur, LLP

(57) ABSTRACT

A massage device for manipulating a user includes a support member and a manipulator carried by the support member. The manipulator is adapted to engage and apply a shear force to the user. The manipulator is rotatable about at least one axis relative to the support member and a brake operably connected to the manipulator selectively adjusts rotation of the manipulator about the at least one axis so that the shear force applied to the user by the manipulator is adjusted. In automatically controlled embodiments, a controller adjusts the braking force according to signals received from a detector to prevent or reduce slippage of the roller and to dynamically control the magnitude of the shear force applied to the user. In manually embodiments, an operator adjusts the braking force to a fixed magnitude or dynamically adjusts the braking force to control the shear force applied to the user.

25 Claims, 11 Drawing Sheets

APPARATUS AND METHOD FOR APPLYING A FRICTION MASSAGE STROKE

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to an apparatus and method for applying pressure to a desired portion of a person's body and, more particularly, to such an apparatus and method for applying a selected friction or shear force on the desired portion of the person's body.

BACKGROUND OF THE INVENTION

The benefits of massage and acupressure have been known for centuries. There are many different kinds of massage styles in existence, and each style has some unique massage stroke. An important Swedish massage stroke is known as the friction or shear stroke. The friction stroke is the deepest of Swedish massage strokes. In applying a friction stroke, the masseur's hands move with the skin instead of gliding across the skin. There are many varieties of the friction stroke such as, for example, this stroke can be done parallel to the deeper muscle fibers (longitudinal friction), in a circular motion over the deeper muscle fibers (circular friction), or across the deeper muscle fibers (cross fiber or transverse friction). Cross fiber friction strokes, in particular, are believed to reduce fibrosis and encourage formation of strong, pliable scar tissue at a healing site of injuries. Cross fiber friction strokes are further believed to reduce crystalline roughness that forms between tendons and their sheaths that can result in painful tendonitis and to prevent or soften myofascial adhesions.

There are three modes of friction that can be utilized in a massage stroke: static friction; sliding friction; and rolling friction. Static friction is characteristic of acupressure and Shiatsu where static friction keeps the acupressure contact from sliding across the massage recipient's body but the primary form of therapy is a force normal to the user's body. Sliding friction is characteristic of Swedish massage where sliding friction provides a shear force applied to the recipient's body which is equal in importance to the normal force applied to the recipient's body. Rolling friction is rarely characteristic of massage by hand but is frequently used by automatic massage systems having massage rollers.

Due to static friction, a static friction force is produced which keeps an object, such as a massaging manipulator, at rest while an external force is applied to the massaging manipulator which is less than a static limit. The static friction force is a reaction force, that is, its value depends on the direction and magnitude of the applied external force trying to move the massaging manipulator along the recipient's skin. The static limit is determined by a coefficient of static friction $\mu_{static}$ multiplied by the normal component of the applied external force. As the applied external force increases, the massaging manipulator "breaks loose" and begins to move relative to the recipient's skin once the applied external force is above the static limit. The magnitude of the applied external force which overcomes the static friction force is called the starting force. It should be appreciated that, due to static friction, the manipulator can produce a shear force on the recipient prior to movement of the manipulator relative to the recipient.

Due to sliding friction (also referred to as dynamic or kinetic friction), a sliding friction force is produced which resists sliding movement of the manipulator when the static limit is overcome and the manipulator is sliding relative to the recipient's skin. The sliding friction force is less then the maximum static friction force but still has some gripping force on the recipient's skin. Typically, sliding friction produces heat as the manipulator is moved along the recipient's skin.

Rolling friction is a much more complex. Due to rolling friction, two primary forces are produced which oppose rolling motion of a massage roller, one acts at the roller's center and the other acts at the area of contact on the user's skin. The force at the roller's center is created by rubbing contact at an axle supporting the roller. The force at the contact zone is created by contact between the roller and the recipient and enables the roller to have traction so that the roller rolls along the recipient rather than slips Another important factor is rolling resistance. Rolling resistance is a loss due to roller/skin deformation or compression and not due to drag between the two surfaces. In rolling friction, the molecules on the wheel's circumference execute cycloidal motion so the molecules in the wheel's contact area hop along the ground as one molecule lifts off the ground another descends to replace it. Because rolling motion does not theoretically involve sliding, the coefficient of static friction applies in rolling friction as well as in static friction. This static friction is combined with the rolling resistance to create the total skin friction of the roller. This skin friction and the axle friction react with an applied force to allow rolling until a certain limit is reached. A state of skidding or slipping occurs when the limiting force is exceeded.

There is a multiplicity of massage devices known in the prior art. These devices range from handheld blocks or immobile probes to automatic massaging chairs and tables having massage rollers. A Backknobber or Jacknobber manufactured by Pressure Positive Company is an example of a typical immobile probe. The probe is used in a stationary fashion as with an acupressure stroke or in a sliding fashion across the recipient's back. When sliding, the probe generates a large amount of shear or friction force which is useful for cross fiber friction strokes as well as other types of strokes.

U.S. Pat. No. 6,283,928 discloses a typical massage apparatus incorporating rollers. The massage rollers are "roller-blade" type wheels that are mounted on a fixed bracket and engage a recipient. As the bracket translates up and down the user's back the rollers spin freely as they roll along the recipient's back. The free spinning or rolling motion of the rollers generate only a small amount of shear or friction force.

There are massaging roller-type devices which include braking mechanisms but the devices do not transfer a shear force to the user. For example, U.S. Pat. No. 6,213,962 discloses a massage device having two massage rollers mounted on a driven shaft which are rotatable relative to each other. Although the disclosure indicates that "braking means be provided for applying a frictional resistance against the rotation of [one of the rollers relative to the other]" and that a second brake means be provided to prevent the overall shaft from rotating when pressed by the user, both of these brakes do not allow the device to apply shear force to the user. In all embodiments of the device, the rollers are mounted behind a membrane which must be designed to slide freely relative to the rollers. In fact, the inventor notes that "it is preferred that the pair of right and left massaging rollers are coupled to the rotary shaft so as to be rotatable relative to the rotary shaft for preventing unnecessary friction against the affected part and the cover member." See column 3, line 57.

There are also massaging devices with friction brakes which are fixed in the degree of friction which they apply. For example, see U.S. Pat. No. 6,071,253 which discloses a spinal column flexing fixture which has a roller with a friction brake. The brake applies a constant friction force which only applies a predetermined and fixed level of rolling resistance. The level of shear resistance cannot be adjusted without disassembling the device and replacing components. However, the roller does not have means of sensing or dynamically controlling shear forces applied to the user.

While each of these prior massaging devices may adequately perform a specific type of massage stroke or other manipulation, they are each limited in the types of massage strokes which they can perform. Accordingly, there is a need in the art for a massage device which is adjustable to selectively produce different magnitudes of shear force so that a larger number of different types of massage strokes can be produces by a single massage manipulator.

SUMMARY OF THE INVENTION

The present invention provides a massage device which overcomes at least some of the above-noted problems of the related art. According to the present invention, a massage device for manipulating a user includes, in combination, a support member and a manipulator carried by the support member. The manipulator is adapted to engage the user and to apply a shear force to the user when the manipulator is moved relative to the user. The manipulator is rotatable about at least one axis relative to the support member. A brake operably connected to the manipulator selectively adjusts rotation of the manipulator about the at least one axis whereby the shear force applied to the user by the manipulator is adjusted.

From the foregoing disclosure and the following more detailed description of various preferred embodiments it will be apparent to those skilled in the art that the present invention provides a significant advance in the technology and art of massage devices. Particularly significant in this regard is the potential the invention affords for providing a high quality, reliable, low cost assembly which can apply an adjustable shear force to a user. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
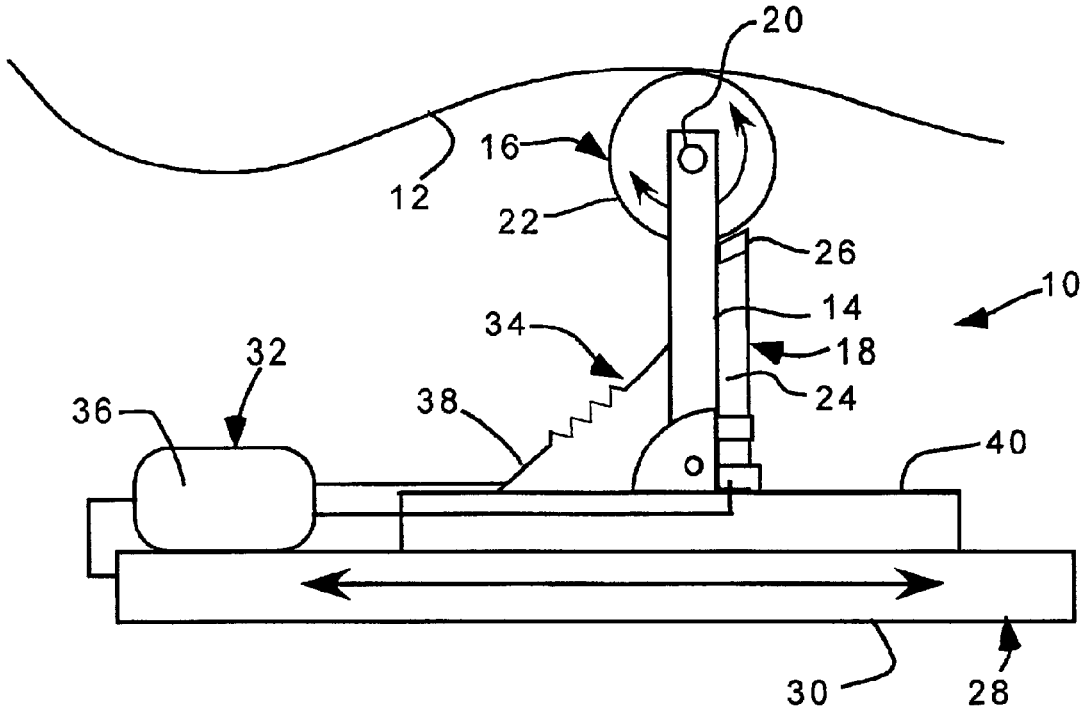
FIG. 1 is an elevational view of a device for applying a frictional massage stroke according to a first embodiment of the present invention.

It should be understood that the appended drawings are not necessarily to scale, presenting a somewhat simplified representation of various preferred features illustrative of the basic principles of the invention. The specific design features of a massage device as disclosed herein, including, for example, specific manipulator shapes and specific types of slippage detectors, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the massage device illustrated in the drawings. In general, up or upward refers to an upward direction within the plane of the paper in FIG. 1 and down or downward refers to a downward direction within the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved massage devices disclosed herein. The following detailed discussion of various alternative and preferred embodiments illustrate the general principles of the invention with reference to several specific embodiments of the present invention. Other embodiments suitable for other applications will be apparent to those skilled in the art given the benefit of this disclosure.

FIG. 1 illustrates a massage device 10 for manipulating and/or massaging a recipient or user 12 according to a first embodiment of the present invention. The illustrated massage device 10 includes a support member 14, a rotatable manipulator 16 adapted to engage and to apply a shear force to the user 12, and a brake 18 operably connected to the manipulator 16 to selectively adjust rotation of the manipulator 16 whereby a magnitude of the shear force applied to the user 12 by the manipulator 16 is adjusted.

The manipulator 16 is preferably carried by the support member 14 at an end thereof and is rotatable relative to the support member 14 about a rotational axis 20. The illustrated rotational axis 20 is substantially parallel to the surface of the user 12 which is to be massaged by the manipulator 16. The illustrated manipulator 16 is a roller 22, that is, a manipulator 16 which rotates about a single fixed axis to roll along the user 12. The illustrated roller 22 is cylindrically-shaped but other suitable shapes can be utilized such as, for example, a spherical shape. It is noted that other types of manipulators 16 can be utilized within the scope of the present invention such as, for example, casters.

The illustrated brake 18 is mounted adjacent the support member and the roller 22 and includes a piston and cylinder assembly 24 having a brake or friction pad 26 located at the end of the piston. The piston and cylinder assembly 24 is arranged to extend and retract the brake pad 26 into and out of engagement with the roller 22. When the brake 18 is actuated, the piston linearly extends from the cylinder to engage the brake pad 26 with the roller 22 to resist rotation of the roller 22 about the rotational axis 20. When the brake 18 is released, the piston linearly retracts toward the cylinder to space the brake pad 26 away from the roller 22 so that the roller 22 is free spinning about the rotational axis 20. The brake pad 26 is preferably provided with a surface having a relatively high coefficient of friction. The engagement of the brake pad 26 applies a frictional or braking force to the roller 22 to resist rotation of the roller 22. The piston cylinder assembly 24 can be actuated in any suitable manner such as, for example, a hydraulic actuator, a pneumatic actuator, and/or electric actuator. It is noted that while the illustrated brake 18 is of a linear-action friction type, the brake can be of any suitable type such as, for example, pivoting type, a caliper type, or drum type.

The illustrated embodiment includes a translator 28 for moving the manipulator 16 along at least one axis relative to the user 12. The illustrated translation axis is substantially parallel to the surface of the user 12 to be massaged by the manipulator 16. The illustrated translator 28 includes a movable carriage 30 upon which the support member 14 and the brake 18 are carried to move the manipulator 16 along a translation path relative to the user 12. The translator 28 can be of any suitable type such as, for example, a single axis linear translator, an X-Y or two-axis translator, or an X-Y-Z or three axis translator. The translator 28 can be also driven in any suitable manner such as, for example, an electric motor, a pneumatic drive system, a hydraulic drive system, and/or a manual drive system. It is noted that means for providing dynamic intensity control can also be provided such as those disclosed in U.S. Pat. No. 6,752,772, the disclosure of which is expressly incorporated herein in its entirety by reference.

The illustrated massage device 10 includes a control system 32 for automatically adjusting the brake 18 to obtain a desired resistance to rotation of the manipulator 16 whereby a magnitude of the shear force applied to the user 12 by the manipulator 16 is automatically adjusted. The control system 32 includes a detector 34 operably connected to the manipulator 16 for detecting or indicating a magnitude or degree of slippage of the roller 22 relative to the user 12 and a controller 36 for automatically operating the brake 18 in response to signals from the detector 34. The illustrated detector 34 is a strain gauge 38 mounted between the support member 14 and a base 40 to which the support member is secured. The detector 34 is in communication with the controller 36 for providing signals thereto. Another detector 34 may be attached bilaterally to allow motion in either direction.

The controller or computer 36 is preferably of the programmable type and is operably connected to the brake 18 for adjustment thereof. During operation, the controller 36 actuates the brake 18 so that a desired shear force is provided to the user 12 by the roller 22. The controller 36 receive signals from the detector 34 and when the controller 36 determines that the roller 22 is in a slipping condition, the controller 36 automatically varies the braking action of the brake 18 until the slipping condition is eliminated. The braking action can be varied in any suitable manner such as, for example, short alternating pulses of full braking force and no braking force (similar to an automobile ABS brake system) and/or gradual or proportional easing of the braking force.

Figure 2:
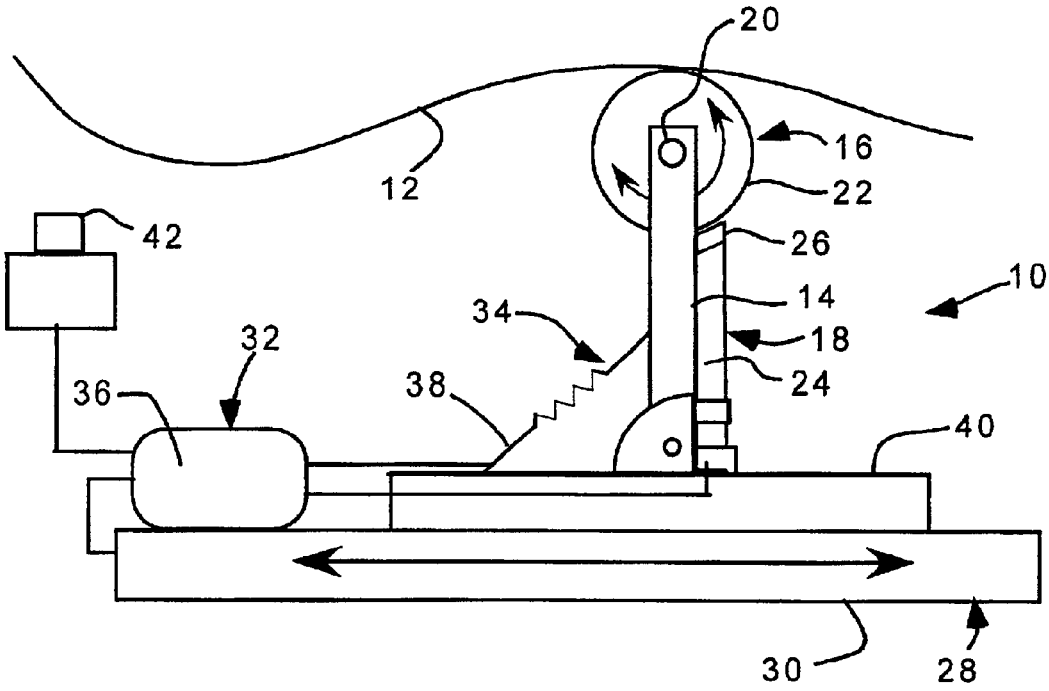
FIG. 2 is an elevational view of a device according to a variation of the device of FIG. 1 wherein a manual control device is utilized to selectively apply a brake.

FIG. 2 illustrates a variation of the massage device of FIG. 1 wherein the control system includes a manual control device 42. The illustrated manual control device 42 is a push button switch but alternatively can any suitable type of switch. The manual control device 42 is operably connected to the controller 36 so that the user can selectively adjust the braking force applied by the brake 18. It is noted that the manual control device 42 can be in addition to or in place of the automatic control system 32 described hereinabove.

Figure 3:
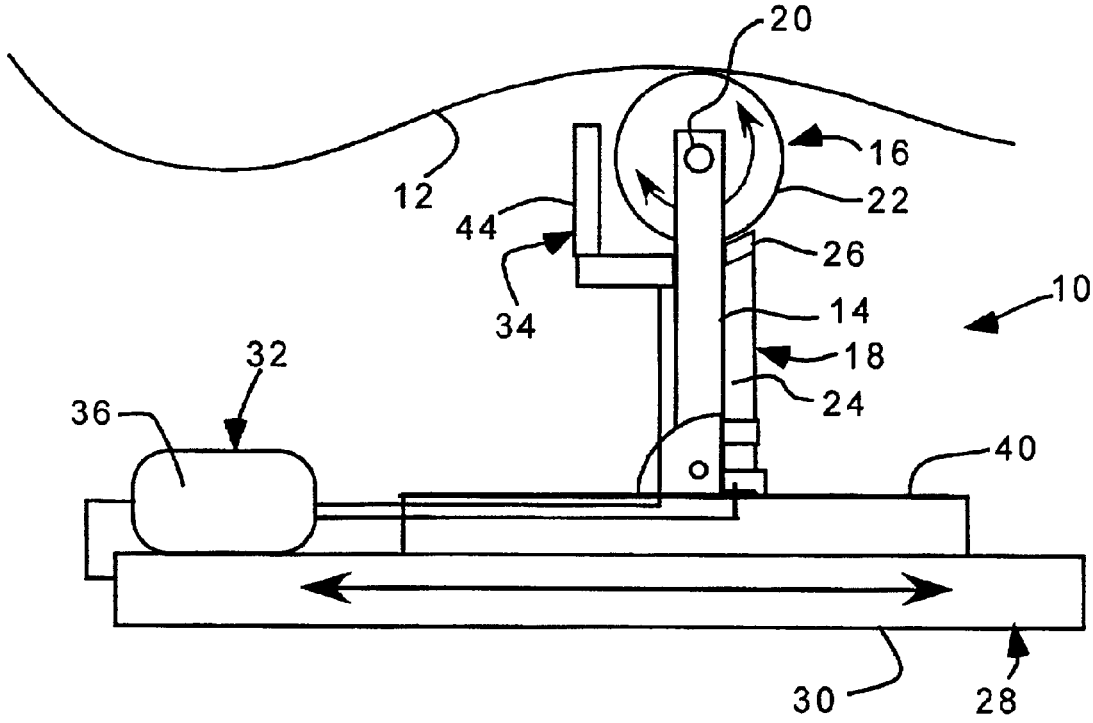
FIG. 3 is an elevational view of a device according to another variation of the device of FIG. 1 wherein an optical sensor is utilized to detect slippage.

FIG. 3 illustrates another variation of the massage device 10 of FIG. 1 wherein the detector 34 is an optical sensor 44. The optical sensor 44 is mounted adjacent the roller 22 and the user 12 to sense movement of the roller 22 and/or the user 12. The optical sensor 44 provides signals to the controller 36 regarding movement of the roller 22. The controller 36, which is in communication with the translator 28 and/or has signals indicating movement of the translator 28, determines whether the roller 22 is in a slip condition.

Figure 4:
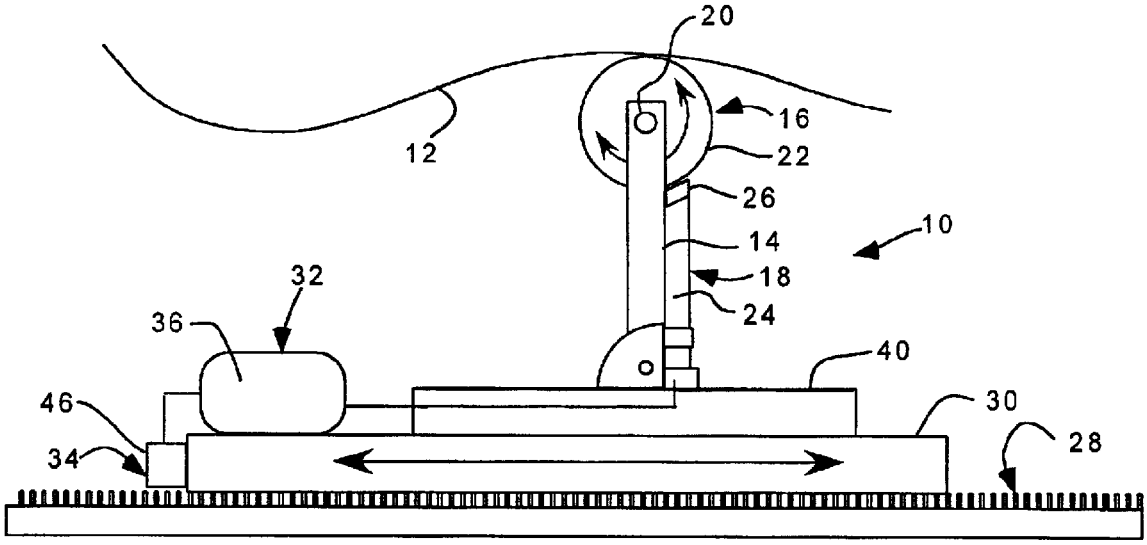
FIG. 4 is an elevational view of a device according to another variation of the device of FIG. 1 wherein an optical sensor is utilized to detect slippage.

FIG. 4 illustrates another variation of the massage device 10 of FIG. 1 wherein the detector 34 is a linear position sensor 46. The linear position sensor 46 is mounted adjacent the translator 28 to sense movement of the carriage 30. The position sensor 46 provides signals to the controller 36 regarding movement of the carriage 30. The controller 36 determines whether there the roller 22 is in or likely to be in a slip condition. It is noted that the linear position sensor 46 is preferably utilized in conjunction with the optical sensor 44 as discussed hereinabove.

Figure 5:
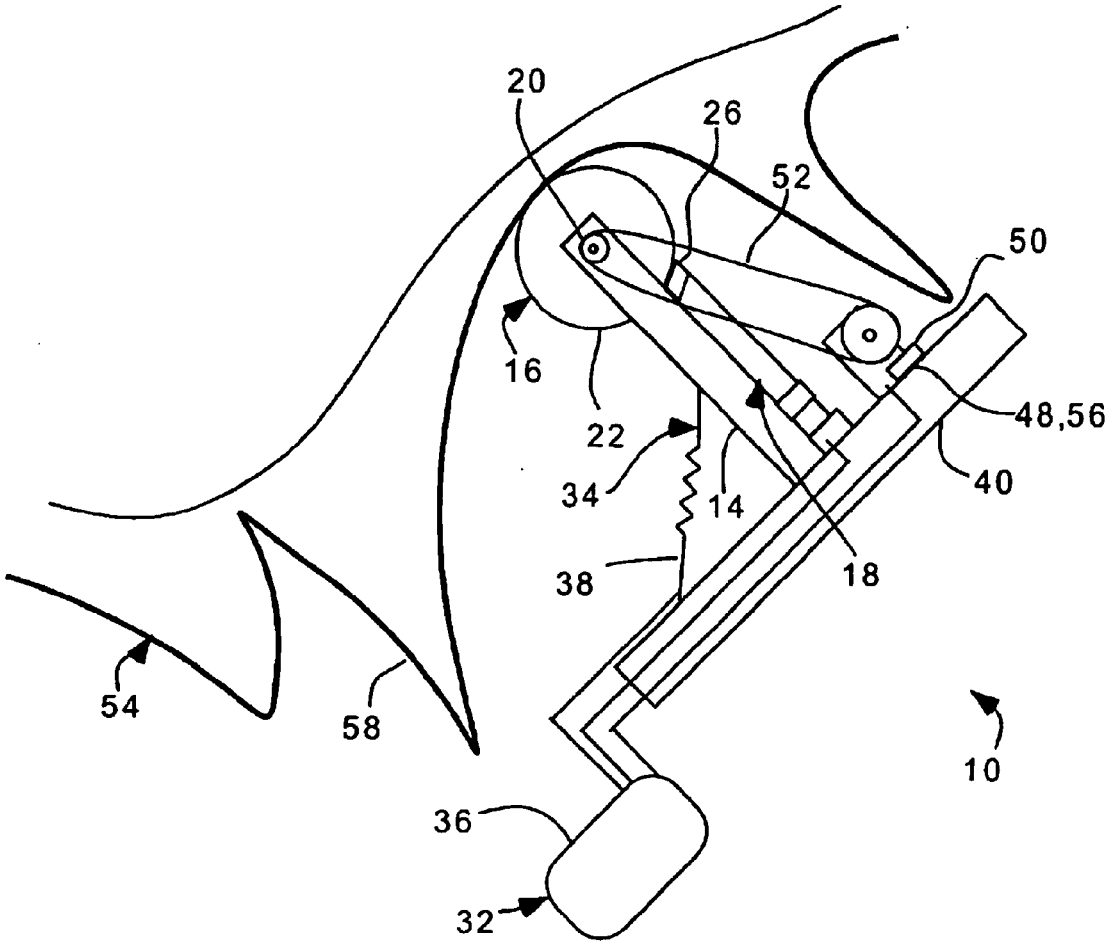
FIG. 5 is an elevational view of a device according to yet another variation of the device of FIG. 1 wherein a roller is provided with a drive mechanism.

FIG. 5 illustrates yet another variation of the massage device 10 of FIG. 1 wherein the roller 22 is provided with a drive mechanism 48 for the roller 22. The illustrated drive mechanism 48 includes an electric motor 50 operatively connected to the roller 22 with a drive belt 52 to selectively directly drive or rotate the roller 22. The drive motor 50 is operably connected to the controller 36 so that the shear force of the roller 22 can be controlled directly without translating or moving the translator carriage 30. The motor 50 rotates the roller 22 until the controller 36 determines from signals of the detector 34 that a desired frictional or shear force is obtained. The motor 50 may provide the controller 36 with torque or current information which are indicative of shear force.

The drive mechanism 48 is particularly advantageous when a flexible interface material or membrane 54 is provided between the roller 22 and the user 12 such as, for example, in a massaging chair. The drive mechanism can also function as a take-up or gathering mechanism 56. This is particularly true when it is desirable to apply friction strokes to the user 12 and the interface material 54 is a non-elastic material. In order to apply friction strokes to the user 12, the interface material 54 must stick to both the user 12 and the roller 22, that is, move with the roller 22 without sliding there between. When slipping occurs, the friction stroke is not applied to the user 12. Therefore, the membrane 54 preferably has a coefficient of friction which substantially prevents sliding of the manipulator relative to the membrane 54. The driven roller 22 can be used to move the interface material 54 and collect the interface material 54 in a series of pleats 58 before the roller 22 is locked against rotation by the brake 18 for application of a friction stroke to the user 12. The excess material in the pleats 58 is then utilized to move the material 54 along with the roller 22 when a friction stroke is applied to the user 12.

Figure 6:
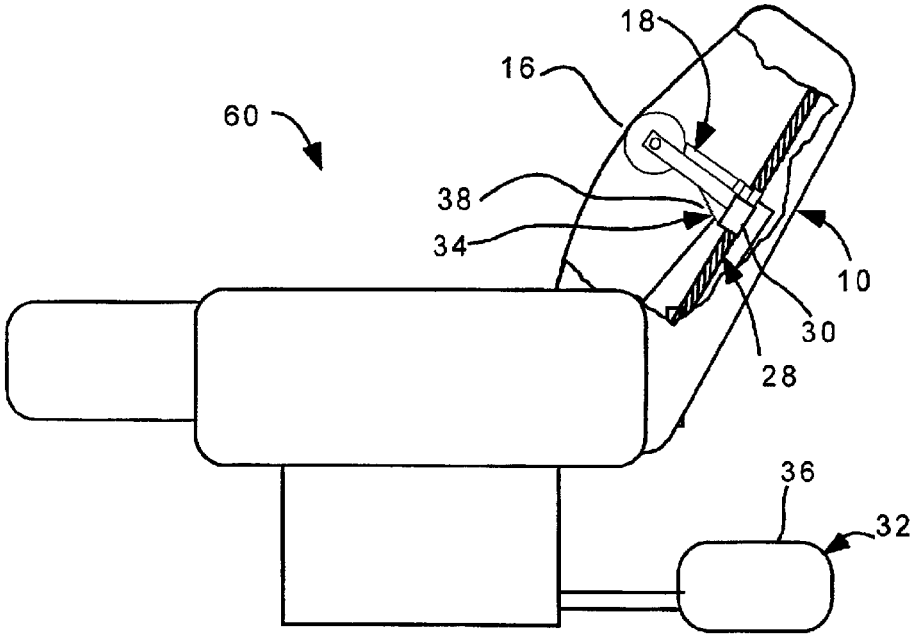
FIG. 6 is an elevational view of an automatic massage chair incorporating the device of FIG. 1.

FIG. 6 illustrates an automatic massage chair 60 incorporating the massage device 10 of FIG. 1. When incorporated into an automatic massage chair 60, the braking force is preferably automatically controlled by the controller 36. The controller 36 is preferably preprogrammed to automatically vary or adjust the braking force applied to the roller 22 by the brake 18 depending on the location on the user 12 being massaged, the preferences of the user 12, and may ramp up from a small amount of braking force at the beginning of a particular massage session to a larger amount of braking force in the middle of the session, and then back down to a small amount of braking force at the end of the session.

Figure 7:
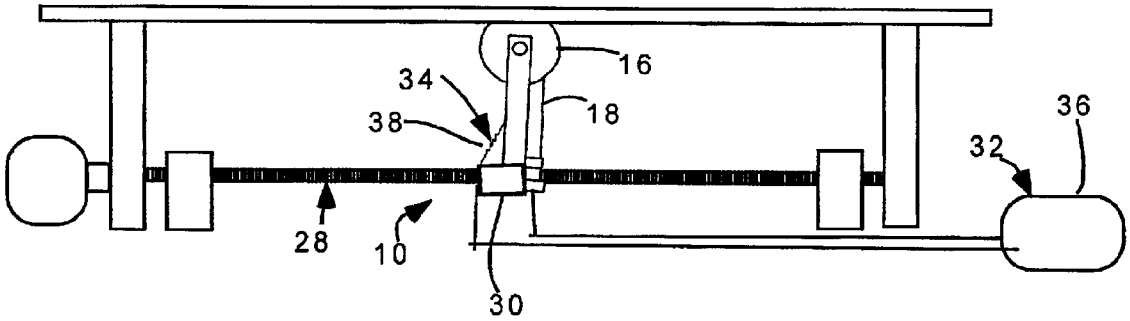
FIG. 7 is an elevational view of an chiropractic therapy table incorporating the device of FIG. 1.

FIG. 7 illustrates a chiropractic therapy table 62 incorporating the massage device 10 of FIG. 1. When incorporated into the chiropractic therapy table 62, the friction strokes are likely to travel along an inferior to superior user axis. Preferably there are a plurality of wide rollers 22 (collectively spanning the width of the user). At least one of these rollers 22 moves along the user's inferior to superior axis relative to the other rollers 22. When the roller 22 moves in one direction for a friction stroke, a braking force is applied to the roller 22 by the brake 18 to increase the friction stroke force to whatever shear force is therapeutic without slipping against the user's skin or clothing. When the roller 22 moves back in the other direction for a recovery stroke, the roller 22 is preferably permitted to rotate or spin freely without a braking force applied thereto.

Figure 8:
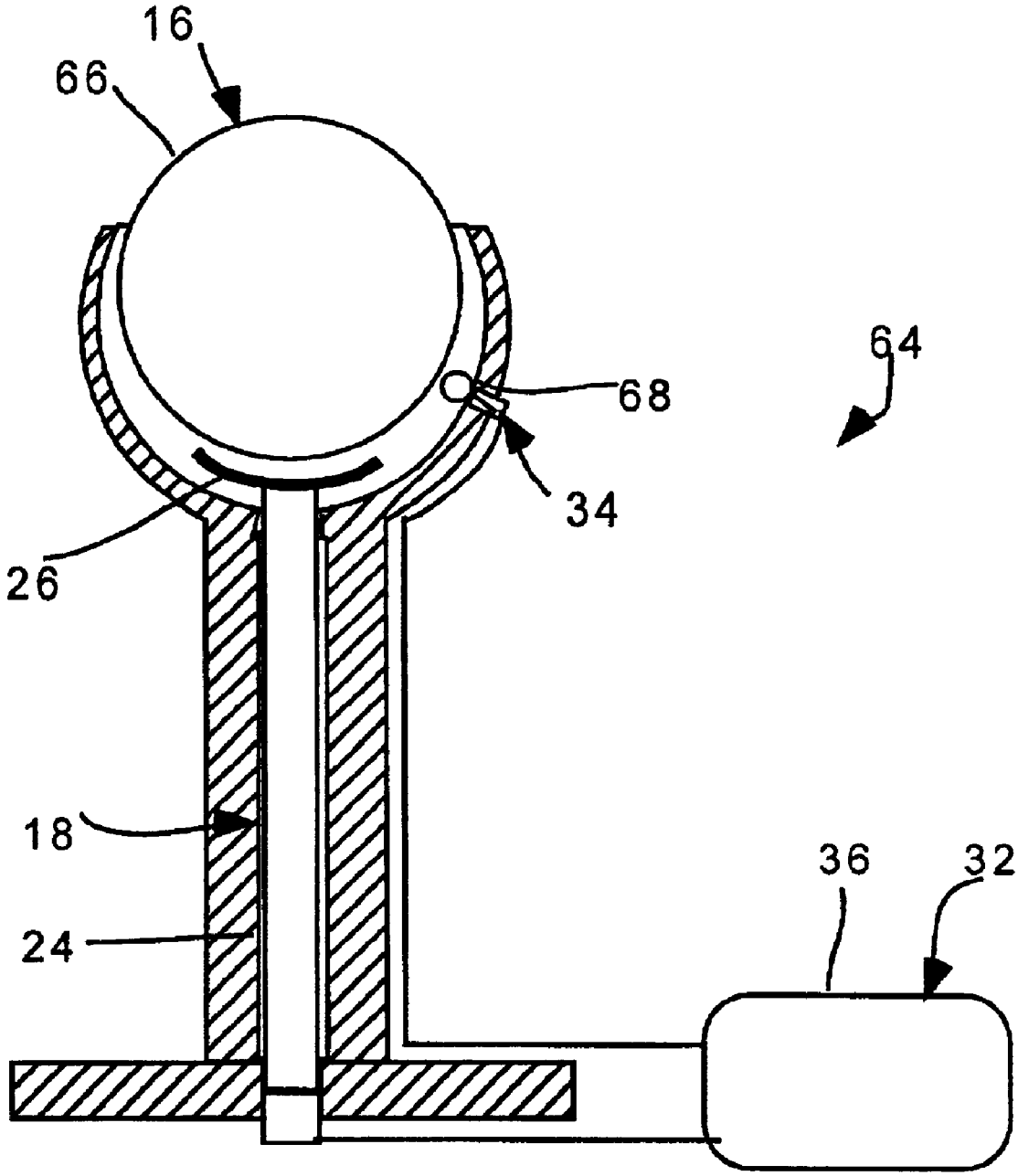
FIG. 8 is an elevational view of a device for applying a frictional massage stroke according to a second embodiment of the present invention.

FIG. 8 illustrates a massage device 64 according to a second embodiment of the present invention wherein like reference numbers are used to indicate like structure. The massage device 64 according to the second embodiment of the invention is substantially the same as the massage device 10 according to the first embodiment of the invention except that different types of the manipulator 16 and the detector 34 are utilized. The manipulator 16 is in the form of a captive sphere or trackball 66 which is rotatable about each and every axis. The brake pad 26 is engagable with the bottom of the sphere 66 to selectively provide resistance to rotation in each axis. The detector 34 is in the form of a rotational sensor 68 which is located adjacent to the sphere 66 to sense movement of the sphere 66 and thereby slippage can be detected. This massage device 64 is particularly useful when incorporated in an automatic massage chair 60 where the translator carriage 30 automatically translates the manipulator 16 over the user's body. Slip condition is detected when the rotational sensor 68 shows less motion of the sphere 66 than should be occurring for the current translation of the manipulator carriage 30.

Figure 9:
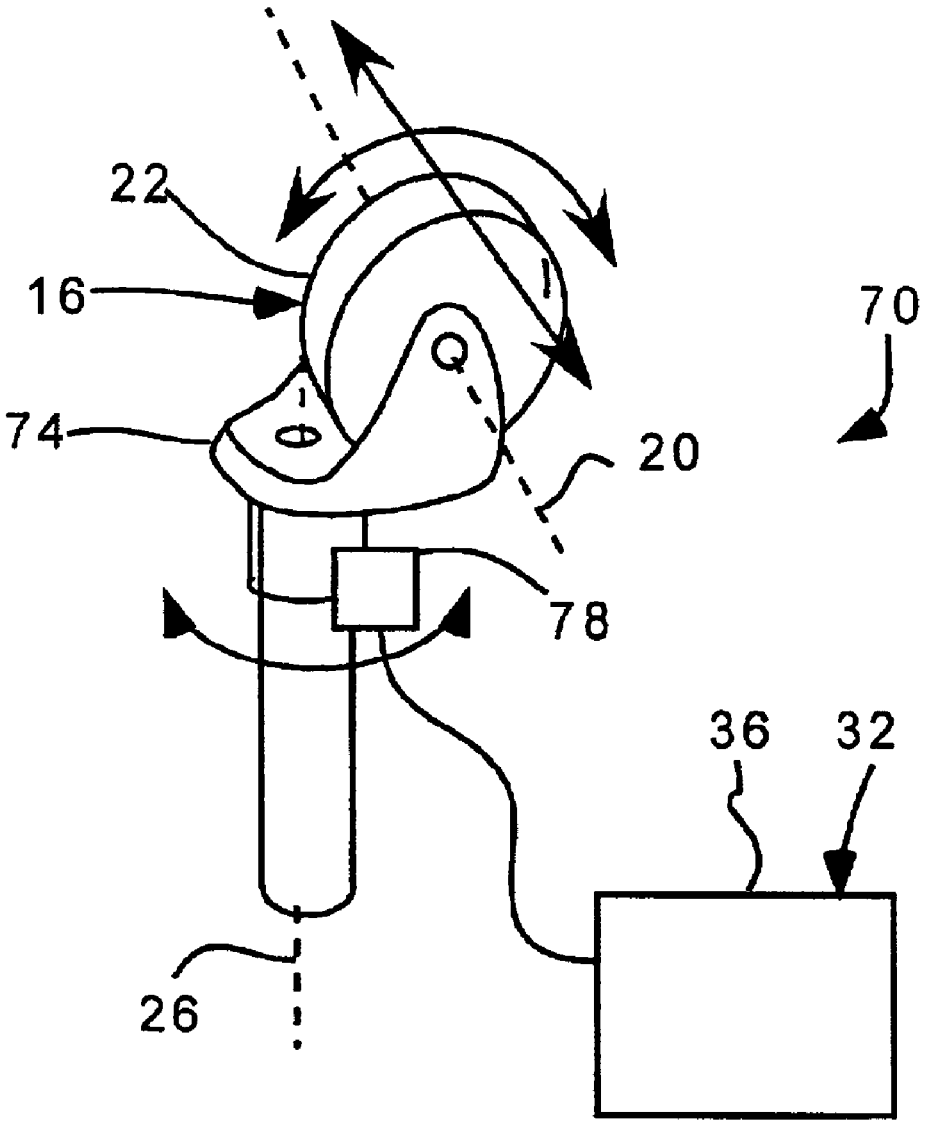
FIG. 9 is an elevational view of a device for applying a frictional massage stroke according to a third embodiment of the present invention.

FIG. 9 illustrates a massage device 70 according to a third embodiment of the present invention wherein like reference numbers are used to indicate like structure. The massage device 70 according to the third embodiment of the invention is substantially the same as the massage device 10 according to the first embodiment of the invention except that different a type of the manipulator 16 is utilized. The manipulator 16 is in the form of a castor 72 which is essentially the roller 22 with a swivel mechanism 74 added thereto. The swivel mechanism 74 allows the roller 22, along with its support arms, to rotate about a second rotational axis 76 which is perpendicular to the first rotational axis 20. The castor 72 has the advantage over the plain roller 22 that the swivel mechanism 74 allows the roller 22 to rotate about the second rotational axis 76 to a desired orientation. This ability to change the orientation of the roller 22 avoids slippage when the roller 22 is moved off a main driven massage axis, that is, when the roller 22 is moved along a translation path other than along a straight line aligned with the roller 22. Due to the swivel mechanism 74, the roller 22 automatically reorients itself to the direction of the massage stroke so that the roller 22 continues to roll rather than sliding or dragging.

The swivel mechanism 74 can be passive but is preferably provided with a control element 78 operably connected to the controller 36. The control element 78 preferably includes at least one of an encoder, a drive motor, and a lock. When the swivel mechanism 74 is passive, the swivel mechanism 74 is preferably offset from the roller 22, that is, the second rotational axis 76 is spaced apart or offset from the first rotational axis 20 rather than intersecting the first rotational axis 20. The offset allows the translator 28 to reorient the roller 22 by driving the roller 22 as one drives a shopping trolley. When the control element 78 includes an encoder, orientation information is provided to the controller 36 so that the controller knows the current orientation of the roller 22. When the control element 78 includes the drive motor, the swivel mechanism 74 can be driven by the controller 36 to reorient the roller 22 to match the direction of the massage stroke. In some circumstances, it may be desirable to drag the roller 22 sideways or with a sideways component such as, for example, 45 degrees off the roller path. In this case, the control element 78 orients the roller 22 at the desired angle while the translator 28 translates the manipulator 16 along a different translation path. When the control element 78 includes the lock, the controller 38 can selectively engage the lock so that the roller 22 no longer rotates about the second rotational axis 76 and the roller 22 remains in its current orientation until the lock is disengaged. In operation, the controller 36 can translate the carriage 30 to achieve the desired orientation for the roller 22 and then engage the lock so that the roller 22 remains in the desired orientation regardless of the direction of later translations of the carriage 30. The carriage 30 can translate in an arbitrary direction achieving a component of slippage at the roller 22 without the roller 22 automatically swiveling to the direction of travel. When the control element 78 includes both the drive motor and the lock, the lock can reduce strain on the drive motor during sideways friction strokes. This may be useful if the drive motor reorients the roller 22 when less normal force is applied enabling the use of a low torque and inexpensive drive motor yet allowing the swivel mechanism 74 to drag sideways without reorienting when desired. It is noted that when the swivel mechanism 74 is passive and aligned on the same axis as the roller 22, that is the second rotational axis 76 intersects the first rotational axis 20, it is possible to have rolling motion about the first rotational axis 20 during a dragging friction stroke in the transverse direction without the lock and/or the drive motor.

Figure 10:
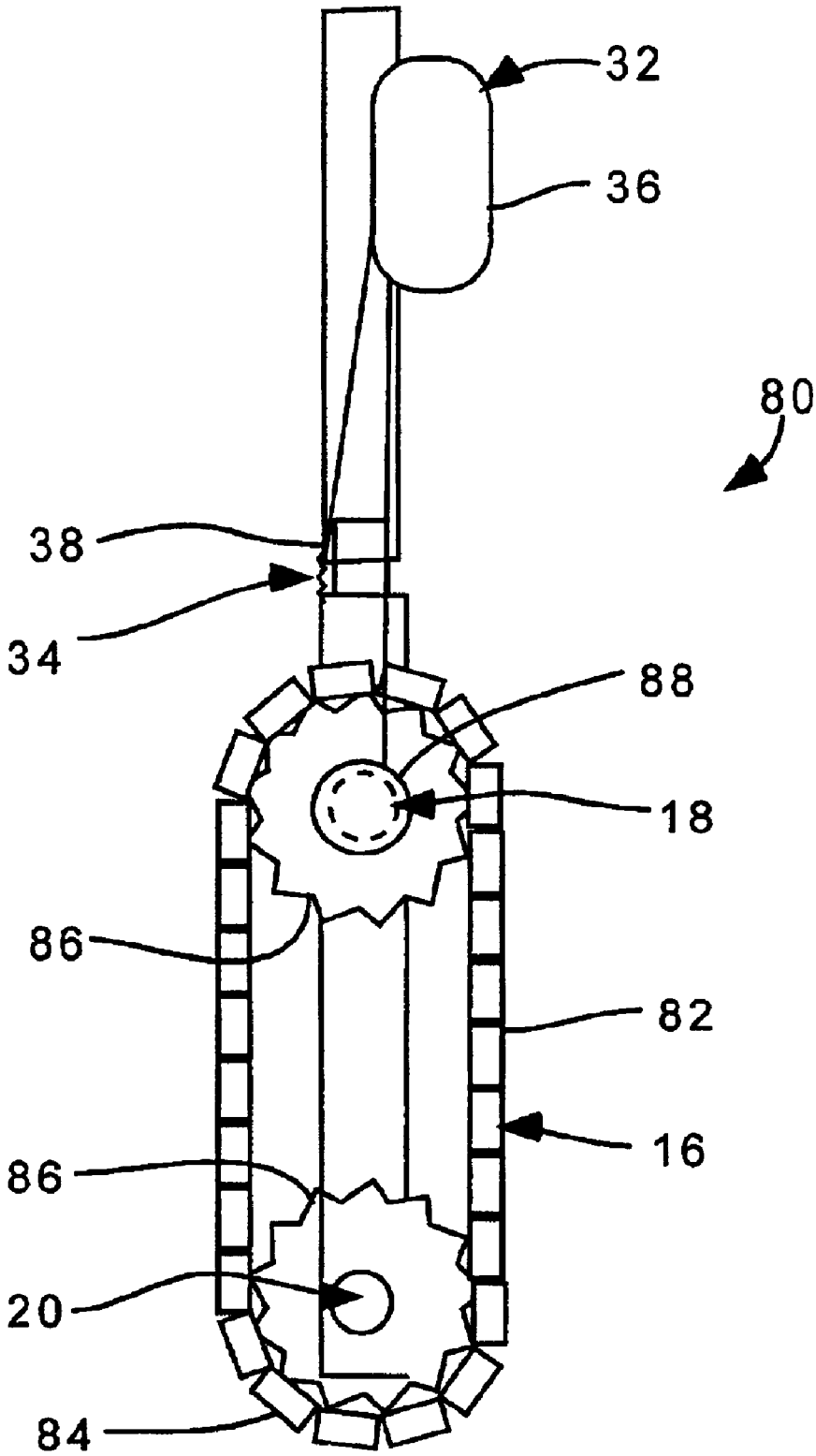
FIG. 10 is an elevational view of a device for applying a frictional massage stroke according to a fourth embodiment of the present invention.

FIG. 10 illustrates a massage device 80 according to a fourth embodiment of the present invention wherein like reference numbers are used to indicate like structure. The massage device 80 according to the fourth embodiment of the invention is substantially the same as the massage device 10 according to the first embodiment of the invention except that different types of the manipulator 16 and the brake 18 are utilized. The manipulator 16 is in the form of a tread assembly 82 having a segmented or continuous flexible belt 84 rotatable about spaced apart wheels or sprockets 86. The illustrated brake 18 is a sprocket brake 88 located at one of the sprockets 86.

Figure 11:
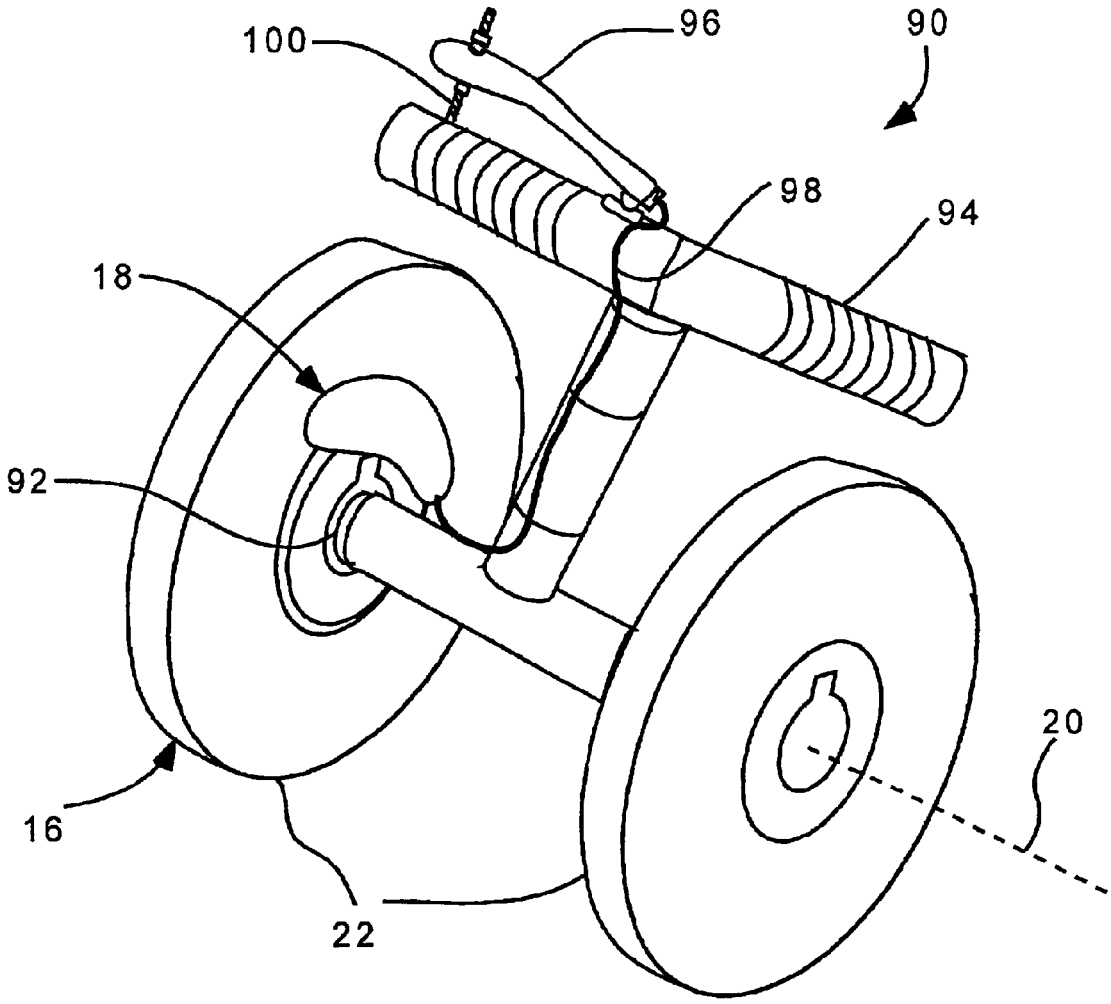
FIG. 11 is an elevational view of a device for applying a frictional massage stroke according to a fifth embodiment of the present invention.

FIG. 11 illustrates a massage device 90 according to a fifth embodiment of the present invention wherein like reference numbers are used to indicate like structure. The massage device 90 according to the fifth embodiment of the invention is substantially the same as the massage device 10 according to the first embodiment except that the manipulator 16 and the brake 18 are each manually operated to form a handheld massage device. The illustrated handheld massage device 90 includes a pair of spaced apart wheels or rollers 22 rotatable supported on a common axle 92. A handle 94 extends from the axle 92 so that the rollers 22 may be manually translated on the surface of a massage recipient. The brake 18 frictionally engages the axle 92 generating resistance to rotation for both rollers 22. The magnitude of the braking force is controlled by a manually operated brake handle 96 located at the device handle 94. The illustrated brake handle 96 is operably connected to the brake 18 by a push-pull or Bowden cable 98. The brake handle 96 is preferably provided with a lock mechanism which when engages holds the brake handle 96 at a location which provides a desired resistance to rotation. The illustrated lock mechanism 100 includes a threaded rod extending through the free end of the brake handle 96 and a pair of jam nuts on the rod at opposite sides of the brake handle 96. When the brake 18 is fully disengaged, the brake 18 provides no resistance to rotation and the rollers 22 are freely rotatable about the axle 92. When the brake 18 is fully engaged, the brake 18 preferably provides enough resistance to rotation to lock the rollers 22 against rotation about the axle 92. When the brake 18 is between fully disengaged and fully engaged, the brake 18 applies a proportional resistance to rotation. For operation, the brake 18 can be locked to a desired friction force or the brake 18 can be manually operated during the massage to dynamically control the friction force applied to the massage recipient.

Figure 12:
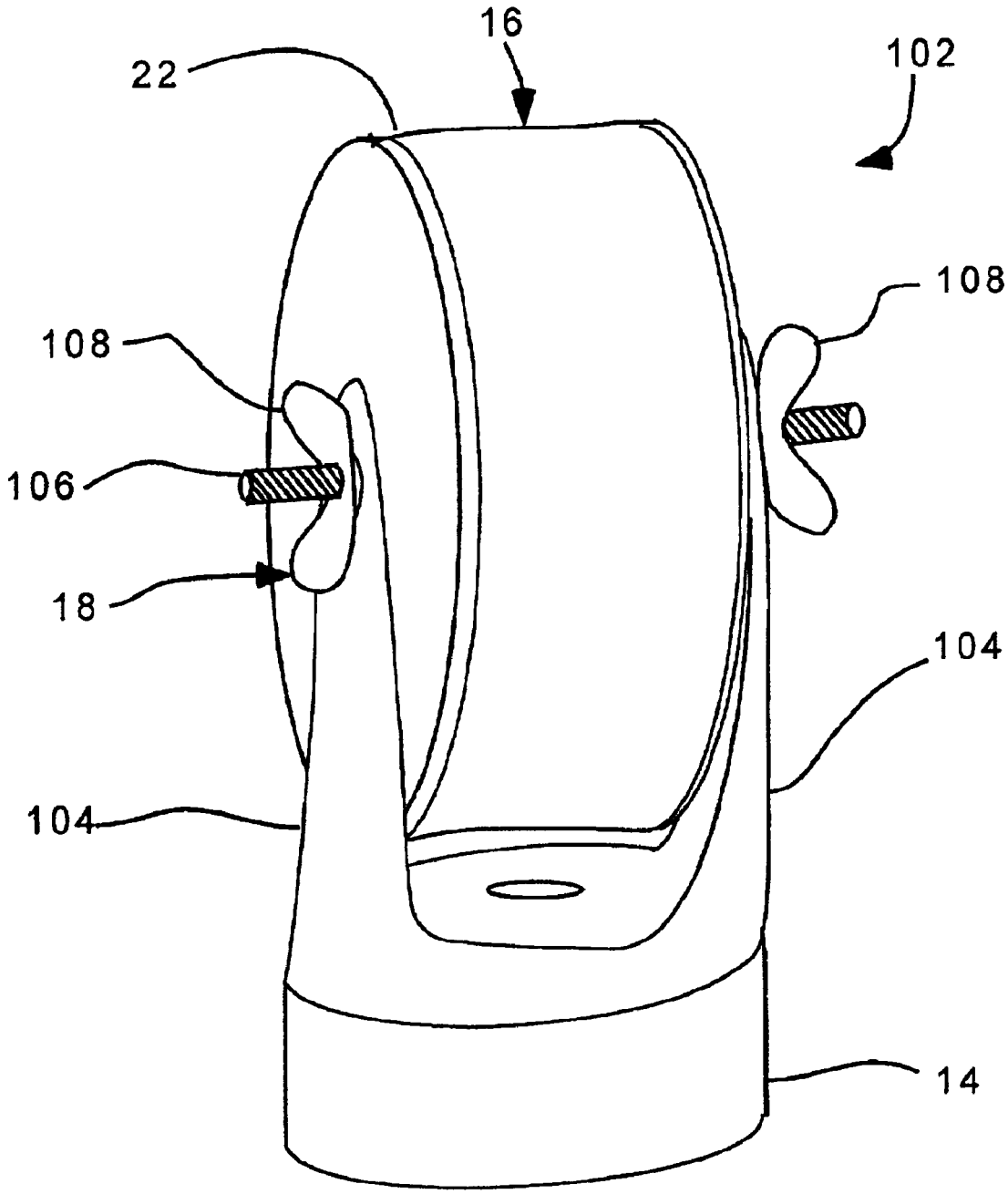
FIG. 12 is an elevational view of a device for applying a frictional massage stroke according to a sixth embodiment of the present invention.

FIG. 12 illustrates a massage device 102 according to a sixth embodiment of the present invention wherein like reference numbers are used to indicate like structure. The massage device 102 according to the sixth embodiment of the invention is substantially the same as the massage device 10 according to the first embodiment of the invention except that the brake 18 is of a different type which provides a fixed amount of mechanical friction which can be manually adjusted between massage sessions or strokes. The illustrated brake 18 includes resiliently flexible arms 104 supporting an axle 106 of the roller 11 on opposite sides of the roller 22. Wing or butterfly nuts 108 are provided on threaded ends of the axle 106 at the outer sides of the arms. The position of the nuts determines the degree to which the arms engage the sides of the roller 22. Preferably, the nuts 108 can be positioned so that the arms 104 are disengaged from the roller 22 so that the roller 22 is freely rotatable and can be positioned so that the arms 104 engage the roller 22 with enough resistance to rotation that the roller 22 is locked against rotation. Preferably, engagement surfaces of the arms 104 and/or the sides of the roller 22 are provided with a high coefficient of friction material.

It is apparent from the above detailed description that the present invention incorporates the advantages of freely rolling wheels or rollers and fixed probes into a single massage device having an adjustable brake is dynamically adjustable to vary resistance to rotation during movement of the manipulator and thus to vary the shear force. The brake can be either mechanically adjustable or electromechanically adjustable to vary the resistance to rotation. The desired shear forces are provided while preventing the rollers from sliding on the user. It is not desired for the massaging roller to slip on the skin because slipping causes irritation to skin, the pulling of body hair, and/or the bunching of the user's clothing, amongst other annoyances. The application of the shear forces are successfully applied to a wide variety of skin types and covering or intervening materials.

It is noted that each of the disclosed features of the various embodiments and variations can be utilized with each of the other disclosed embodiments and variations. For example, the optical sensor 66 of the second embodiment can be used with the first embodiment and the manual control device 42 of a variation of the first embodiment can be used with the second embodiment.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A massage device for manipulating a user, the device comprising, in combination:

a support member;

a manipulator carried by the support member and adapted to engage and apply a shear force to the user;

wherein the manipulator is rotatable relative to the support member about at least one axis;

a brake operably connected to the manipulator to selectively adjust resistance to rotation of the manipulator about the at least one axis whereby the shear force applied to the user by the manipulator is adjusted;

a translator operatively connected to the support member to selectively move the manipulator relative to the user such that the manipulator moves along the user; and a controller operatively connected to the translator and the brake such that the controller controls the translator to move the manipulator along a desired translation path along the user and automatically adjusts the brake to vary resistance to rotation of the manipulator about the at least one axis in real time as the manipulator moves along the desired translation path along the user to maintain a desired magnitude of the shear force applied to the user by the manipulator.

2. The massage device according to claim 1, wherein the manipulator is a roller.

3. The massage device according to claim 1, wherein the manipulator is a captive sphere.

4. The massage device according to claim 1, wherein the manipulator is a castor.

5. The massage device according to claim 4, further comprising an encoder indicating an orientation of the castor.

6. The massage device according to claim 4, further comprising a motor operably connected to the caster to selectively change an orientation of the castor.

7. The massage device according to claim 4, further comprising a lock operably connected to the caster to selectively lock an orientation of the castor.

8. The massage device according to claim 1, wherein the manipulator is a belt.

9. The massage device according to claim 1, wherein the brake selectively applies a friction force to the manipulator which provides a resistance to rotation about the at least one axis.

10. The massage device according to claim 1, further comprising a motor operably connected to the manipulator to rotate the manipulator about the at least one axis.

11. The massage device according to claim 10, wherein the controller operatively connected to the motor and adapted to automatically vary resistance to rotation of the manipulator to maintain a desired magnitude of the shear force.

12. The massage device according to claim 1, wherein the brake is mechanically adjustable to vary the resistance to rotation.

13. The massage device according to claim 1, wherein the brake is electromechanically adjustable to vary the resistance to rotation.

14. The massage device according to claim 1, wherein the brake is dynamically adjustable to vary the resistance to rotation during movement of the manipulator.

15. The massage device according to claim 1, further comprising a detector operably connected to the manipulator to detect slippage between the manipulator and the user.

16. The massage device according to claim 15, wherein the detector is selected from the group of a rotational sensor, a torque sensor, a linear position sensor, a force transducer, a deflection transducer, and an optical sensor.

17. The massage device according to claim 1, further comprising a detector operably connected to the manipulator to detect slippage of the manipulator and the controller operably connected to the detector and the brake, and wherein the controller is adapted to automatically adjust the brake to substantially prevent slippage of the manipulator.

18. The massage device according to claim 17, wherein the controller is adapted to pulse the resistance to rotation applied to the manipulator by the brake to substantially prevent slippage of the manipulator.

19. The massage device according to claim 17, wherein the controller is adapted to proportionally adjust the resistance to rotation applied to the manipulator by the brake to substantially prevent slippage of the manipulator.

20. The massage device according to claim 1, further comprising a flexible intervening membrane through which the manipulator engages the user.

21. The massage device according to claim 20, further comprising a gathering mechanism to form pleats in the intervening membrane.

22. The massage device according to claim 20, wherein the intervening membrane has a coefficient of friction which substantially prevents sliding of the manipulator relative to the intervening membrane.

23. The massage device according to claim 1, wherein the manipulator directly engages the user without an intervening membrane therebetween.

24. The massage device according to claim 1, wherein the massage device is a massage chair.

25. The massage device according to claim 1, wherein the massage device is a physical therapy traction device.

* * * * *